US009295883B2

(12) United States Patent
Sullivan et al.

(10) Patent No.: US 9,295,883 B2
(45) Date of Patent: Mar. 29, 2016

(54) GOLF BALL CORE HAVING MEDIUM POSITIVE HARDNESS GRADIENT AND HIGH SURFACE HARDNESS

(71) Applicant: Acushnet Company, Fairhaven, MA (US)

(72) Inventors: Michael J. Sullivan, Old Lyme, CT (US); Brian Comeau, Berkley, MA (US); Dennis Britton, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/108,580

(22) Filed: Mar. 6, 2014

(65) Prior Publication Data

US 2014/0256474 A1 Sep. 11, 2014

Related U.S. Application Data

(60) Division of application No. 12/706,781, filed on Feb. 17, 2010, now Pat. No. 8,690,713, which is a continuation-in-part of application No. 12/047,982, filed on Mar. 13, 2008, now abandoned, which is a continuation-in-part of application No. 11/767,070, filed on Jun. 22, 2007, now abandoned, which is a continuation-in-part of application No. 10/773,906, filed on Feb. 6, 2004, now Pat. No. 7,255,656, which is a continuation-in-part of application No. 10/341,574, filed on Jan. 13, 2003, now Pat. No. 6,852,044, which is a continuation-in-part of application No. 10/002,641, filed on Nov. 28, 2001, now Pat. No. 6,547,677.

(51) Int. Cl.
*A63B 37/06* (2006.01)
*A63B 37/00* (2006.01)
*A63B 37/02* (2006.01)

(52) U.S. Cl.
CPC ..... *A63B 37/0063* (2013.01); *A63B 37/0003* (2013.01); *A63B 37/0039* (2013.01); *A63B 37/0043* (2013.01); *A63B 37/0044* (2013.01); *A63B 37/0062* (2013.01); *A63B 37/0064* (2013.01); *A63B 37/0066* (2013.01); *A63B 37/0076* (2013.01); *A63B 37/0092* (2013.01); *A63B 37/02* (2013.01)

(58) Field of Classification Search
CPC ..... A63B 37/0063
USPC ..... 473/373, 374
See application file for complete search history.

(56) References Cited

U.S. PATENT DOCUMENTS

| | | | | |
|---|---|---|---|---|
| 5,782,707 | A | 7/1998 | Yamagishi et al. | |
| 5,820,487 | A * | 10/1998 | Nakamura et al. | 473/374 |
| 5,830,085 | A * | 11/1998 | Higuchi et al. | 473/373 |
| 6,679,791 | B2 | 1/2004 | Watanabe | |

(Continued)

*Primary Examiner* — Raeann Gorden
(74) *Attorney, Agent, or Firm* — William B. Lacy

(57) ABSTRACT

A golf ball includes a single solid core having a surface hardness and a geometric center hardness. The core has an outer diameter of about 1.5 to 1.62 inches. An outer cover layer formed from a polyurea or polyurethane has a first hardness, and an inner cover layer, disposed between the core and the outer cover, has a second hardness greater than the first hardness and within 5 Shore C of the core surface hardness. The geometric center hardness is about 64 to 85 Shore C, and the core surface hardness is greater than 85 Shore C and harder than the geometric center hardness by about 5 to 22 Shore C to define a positive hardness gradient.

7 Claims, 1 Drawing Sheet

(56) References Cited

U.S. PATENT DOCUMENTS

| | | | | |
|---|---|---|---|---|
| 6,686,436 | B2 | 2/2004 | Iwami | |
| 6,702,694 | B1 * | 3/2004 | Watanabe | 473/371 |
| 6,786,836 | B2 | 9/2004 | Higuchi et al. | |
| 7,086,969 | B2 | 8/2006 | Higuchi et al. | |
| 7,153,224 | B2 | 12/2006 | Higuchi et al. | |
| 7,175,542 | B2 | 2/2007 | Watanabe et al. | |
| 7,226,367 | B2 | 6/2007 | Higuchi et al. | |
| 2007/0093318 | A1 | 4/2007 | Bartsch et al. | |

* cited by examiner

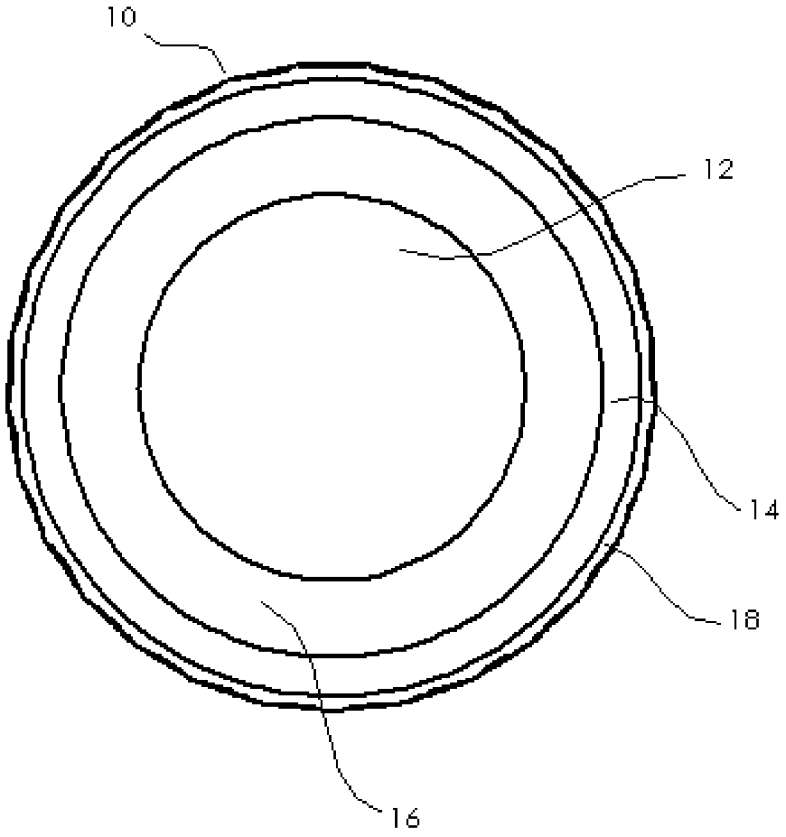
10
12
14
18
16

GOLF BALL CORE HAVING MEDIUM POSITIVE HARDNESS GRADIENT AND HIGH SURFACE HARDNESS

CROSS-REFERENCE TO RELATED APPLICATIONS

This application is a divisional of U.S. patent application Ser. No. 12/706,781, filed Feb. 17, 2010, which is a continuation-in-part of U.S. patent application Ser. No. 12/047,982, filed Mar. 13, 2008 and now abandoned, which is a continuation-in-part of U.S. patent application Ser. No. 11/767,070, filed Jun. 22, 2007 and now abandoned, which is a continuation-in-part of U.S. patent application Ser. No. 10/773,906, filed Feb. 6, 2004 and now U.S. Pat. No. 7,255,656, which is a continuation-in-part of U.S. patent application Ser. No. 10/341,574, filed Jan. 13, 2003 and now U.S. Pat. No. 6,852,044, which is a continuation-in-part of U.S. patent application Ser. No. 10/002,641, filed Nov. 28, 2001 and now U.S. Pat. No. 6,547,677, the entire disclosures of which are hereby incorporated herein by reference.

FIELD OF THE INVENTION

The present invention generally relates to golf balls having one or more core layers, where the outermost core surface has a Shore C hardness of greater than 85 and the core has a "positive hardness gradient" of less than 22 Shore C. The core is generally a one- or two-piece core. The inner cover layer has a hardness of greater than the outer cover layer and is within 5 Shore C of the hardness of the core surface.

BACKGROUND OF THE INVENTION

Numerous golf balls having a multilayer construction wherein the core hardness and cover hardness have been variously improved are disclosed in the prior art. For example, U.S. Pat. No. 6,987,159 to Iwami discloses a solid golf ball with a solid core and a polyurethane cover, wherein the difference in Shore D hardness between a center portion and a surface portion of the solid core is at least 15, the polyurethane cover has a thickness (t) of not more than 1.0 mm and is formed from a cured urethane composition having a Shore D hardness (D) of from 35 to 60, and a product of t and D ranges from 10 to 45.

U.S. Pat. No. 7,175,542 to Watanabe et al. discloses a multi-piece solid golf ball composed of a multilayer core having at least an inner core layer and an outer core layer, one or more cover layers which enclose the core, and numerous dimples formed on a surface of the cover layer. The golf ball is characterized in that the following hardness conditions are satisfied: (1) (JIS-C hardness of cover)-(JIS-C hardness at center of core)≥27, (2) 23≤(JIS-C hardness at surface of core)-(JIS-C hardness at center of core)≤40, and (3) 0.50≤[(deflection amount of entire core)/(deflection amount of inner core layer)]≤0.75.

U.S. Pat. No. 6,679,791 to Watanabe discloses a multi-piece golf ball which includes a rubbery elastic core, a cover having a plurality of dimples on the surface thereof, and at least one intermediate layer between the core and the cover. The intermediate layer is composed of a resin material which is harder than the cover. The elastic core has a hardness which gradually increases radially outward from the center to the surface thereof. The center and surface of the elastic core have a hardness difference of at least 18 JIS-C hardness units.

U.S. Pat. No. 5,782,707 to Yamagishi et al. discloses a three-piece solid golf ball consisting of a solid core, an intermediate layer, and a cover, wherein the hardness is measured by a JIS-C scale hardness meter, the core center hardness is up to 75 degrees, the core surface hardness is up to 85 degrees, the core surface hardness is higher than the core center hardness by 8 to 20 degrees, the intermediate layer hardness is higher than the core surface hardness by at least 5 degrees, and the cover hardness is lower than the intermediate layer hardness by at least 5 degrees.

Additional examples can be found, for example, in U.S. Pat. No. 6,686,436 to Iwami, U.S. Pat. No. 6,786,836 to Higuchi et al., U.S. Pat. No. 7,153,224 to Higuchi et al., and U.S. Pat. No. 7,226,367 to Higuchi et al.

The present invention provides a novel multilayer golf ball construction which may provide one or more of the following benefits: lower spin due to a relatively high core gradient, higher spin on full iron shots due to an outer core surface which is harder than the inner cover surface, and superior overall ball performance properties.

SUMMARY OF THE INVENTION

The present invention is directed to a golf ball formed from a single, solid core, an inner cover layer, and an outer cover layer. The solid core is preferably unitary and homogeneous (i.e., formed from a single composition, such as a polybutadiene composition) and can have any diameter, but preferably the outer diameter is about 1.5 to 1.62 inches, more preferably about 1.51 to 1.60 inches, and most preferably about 1.53 to 1.58 inches. The solid core has a surface hardness and a geometric center hardness.

The geometric center hardness is preferably about 64 to 85 Shore C and the core surface hardness is preferably greater than 85 Shore C. The core surface hardness is more preferably about 86 to 98 Shore C and most preferably about 88 to 94 Shore C. The core surface hardness is higher (harder) than the geometric center hardness by about 5 to 22 Shore C to define a medium positive hardness gradient. Preferably the hardness gradient is about 7 to 20 Shore C, more preferably about 10 to 18 Shore C. In a particularly preferred embodiment, the geometric center hardness is about 75 Shore C and the core surface hardness is about 89 Shore C to define a medium positive hardness gradient of about 14 Shore C.

In this embodiment, the outer cover layer is formed from a polyurea, a polyurethane, or a hybrid thereof, and has a first hardness, and the inner cover layer has a second hardness greater than the first (cover) hardness and is within about 5 Shore C of the core surface hardness.

The present invention is also directed to a golf ball formed from a solid dual core (formed from an inner core layer and an outer core layer), an inner cover layer, and an outer cover layer. The inner core layer has a geometric center hardness of about 66 to 80 Shore C and a surface hardness of about 65 to 80 Shore C and is about 0 to 5 Shore C, preferably about 1 to 5 Shore C, harder than the center hardness to define a shallow positive hardness gradient. The outer core layer preferably has a surface hardness of about 86 to 96 Shore C and is harder than the geometric center by about 10 to 20 Shore C to define a positive hardness gradient. Preferably, the hardness gradient is about 12 to 18 Shore C, more preferably about 13 to 16 Shore C. Preferably, the geometric center hardness is about 67 to 75 Shore C, more preferably about 68 to 72 Shore C.

The outer core layer surface hardness is preferably about 89 to 91 Shore C. In one particularly preferred embodiment, the inner core layer preferably has an outer diameter of about 1.0 inches and the outer core layer has an outer diameter of about 1.55 inches. The inner or outer core layers may also be formed from a polybutadiene rubber and about 1 to 100 phr of a stiffening thermoplastic polymer, such as polyisoprene, trans butadiene rubbers, ionomer, acid co- or ter-polymers, polyamides, polyesters, polyoctenemers, styrene butadiene copolymers, polyether-esters, polyamide-esters, or polyethylene copolymers.

The outer cover layer has a Vicker's hardness of about 0.18 to 0.40, more preferably about 0.2 to 0.35 as measured on the ball at 0.49 N with a 10-s hold time. The inner cover layer is formed from an ionomer or ionomer-based blend and is typically disposed between the core and the outer cover layer. The inner or outer cover layers may be formed from an ionomer or a blend thereof, a polyurea, a polyurethane, a urethane-urea hybrid, a urea-urethane hybrid, a castable epoxy, a metallocene-catalyzed polyolefin, ionomers, ethylene-acrylic or -methacrylic acid copolymers or terpolymers, highly-neutralized ionomers, thermoset diene rubbers, polyether-esters, polyamide-esters, or polyether-amides.

The present invention is further directed to a golf ball formed from an inner core layer, an outer core layer, an inner cover layer, and an outer cover layer. The inner core layer has a geometric center hardness of about 66 to 82 Shore C and a surface hardness of about 62 to 78 Shore C. The surface hardness is lower (softer) than the center hardness to define a "negative hardness gradient." Preferably, the geometric center hardness is about 70 to 80 Shore C and/or the core surface hardness is about 66 to 74 Shore C. The outer core layer preferably has a surface hardness of about 86 to 96 Shore C, and is harder than the geometric center by about 10 to 20 Shore C to define a "positive hardness gradient." The positive hardness gradient is more preferably about 12 to 18 Shore C, and most preferably about 13 to 16 Shore C. The outer core layer may also include a stiffening thermoplastic polymer, The outer cover layer is preferably formed from a polyurea, a polyurethane, or a hybrid thereof. The outer cover layer should have a Vicker's hardness of about 0.18 to 0.40, as measured on the ball at 0.49 N with a 10-s hold time. The inner cover layer is preferably formed from an ionomer or ionomer blend, and is generally disposed between the core and the outer cover layer.

BRIEF DESCRIPTION OF THE DRAWINGS

These and other aspects of the present invention may be more fully understood with reference to, but not limited by, the following drawings.

FIG. 1 is a representative cross section of a golf ball of the invention.

DETAILED DESCRIPTION OF THE INVENTION

A golf ball having a dual core (i.e., two-layer core) and a dual cover (i.e., two-layer cover) enclosing the core is disclosed. The dual core consists of a center and an outer core layer. The center has a diameter within a range having a lower limit of 0.75 or 1.00 or 1.10 or 1.20 inches and an upper limit of 1.30 or 1.35 or 1.40 inches. The outer core layer encloses the center such that the two-layer core has an overall diameter within a range having a lower limit of 1.40 or 1.50 or 1.51 or 1.52 or 1.525 inches and an upper limit of 1.54 or 1.55 or 1.555 or 1.56 or 1.59 inches.

Preferably, the center has a center hardness of 50 Shore C or greater, or 55 Shore C or greater, or 60 Shore C or greater, or a center hardness within a range having a lower limit of 50 or 55 or 60 Shore C and an upper limit of 65 or 70 or 80 Shore C. The center preferably has a surface hardness of 65 Shore C or greater, or 70 Shore C or greater, or a surface hardness within a range having a lower limit of 55 or 60 or 65 or 70 Shore C or 75 Shore C and an upper limit of 80 or 85 Shore C. The outer core layer preferably has a surface hardness of 75 Shore C or greater, or 80 Shore C or greater, or greater than 80 Shore C, or 85 Shore C or greater, or greater than 85 Shore C, or 87 Shore C or greater, or greater than 87 Shore C, or 90 Shore C or greater, or greater than 90 Shore C, or a surface hardness within a range having a lower limit of 75 or 80 or 85 or 90 Shore C and an upper limit of 95 Shore C.

In a particular embodiment, the surface hardness of the center is greater than or equal to the center hardness of the center. In another particular embodiment, the center has a positive hardness gradient wherein the surface hardness of the center is at least 10 Shore C units greater than the center hardness of the center.

In a particular embodiment, the surface hardness of the outer core layer is greater than or equal to the surface hardness and center hardness of the center. In another particular embodiment, the core has a positive hardness gradient wherein the surface hardness of the outer core layer is at least 20 Shore C units greater, or at least 25 Shore C units greater, or at least 30 units greater, than the center hardness of the center.

The surface hardness of a center or outer core layer is obtained from the average of a number of measurements taken from opposing hemispheres of a core, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface of a core, care must be taken to insure that the core is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand, such that the weight on the durometer and attack rate conform to ASTM D-2240.

The center hardness of the core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90° to this orientation prior to securing. A measurement is also made from the bottom of the holder to the top of the core to provide a reference point for future calculations. A rough cut, made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height of the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark.

The center is preferably formed from a rubber composition or from a highly resilient thermoplastic polymer such as a highly neutralized polymer ("HNP") composition. Particularly suitable thermoplastic polymers include SURLYN® ionomer resins, HYTREL® thermoplastic polyester elastomers, and ionomeric materials sold under the tradenames HPF 1000 and HPF 2000, all of which are commercially-available from DuPont ("DuPont"); IOTEK® ionomers, commercially-available from ExxonMobil Chemical Company; and PEBAX® thermoplastic polyether block amides, commercially-available from Arkema Inc.

Suitable HNP compositions for use in forming the center comprise an HNP and optionally additives, fillers, and/or melt flow modifiers. Suitable HNPs are salts of homopolymers and copolymers of α,β-ethylenically unsaturated mono- or dicarboxylic acids, and combinations thereof, optionally including a softening monomer. The acid polymer is neutralized to 70% or higher, including up to 100%, with a suitable cation source. Suitable additives and fillers include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers. Suitable melt flow modifiers include, for example, fatty acids and salts thereof, polyamides, polyesters, polyacrylates, polyurethanes, polyethers, polyureas, polyhydric alcohols, and combinations thereof. Suitable HNP compositions also include blends of HNPs with partially neutralized ionomers as disclosed, for example, in U.S. Pat. No. 7,652,086, the entire disclosure of which is hereby incorporated herein by reference, and blends of HNPs with additional thermoplastic and thermoset materials, including, but not limited to, ionomers, acid copolymers, engineering thermoplastics, fatty acid/salt-based highly neutralized polymers, polybutadienes, polyurethanes, polyesters, thermoplastic elastomers, and other conventional polymeric materials. Particularly suitable as a core layer material is HPF 1000. Suitable HNP compositions are further disclosed, for example, in U.S. Pat. No. 6,653,382, the entire disclosure of which is hereby incorporated herein by reference.

Suitable rubber compositions for use in forming the center comprise a base rubber, a crosslinking agent, a filler, and a co-crosslinking or initiator agent. Typical base rubber materials include natural and synthetic rubbers, and combinations of two or more thereof. The base rubber is preferably polybutadiene or a mixture of polybutadiene with other elastomers. Particularly preferred is 1,4-polybutadiene having a cis-structure of at least 40%. More preferably, the base rubber is a high-Mooney-viscosity rubber. Lesser amounts of other thermoset materials may be incorporated into the base rubber. Such materials include, for example, cis-polyisoprene, trans-polyisoprene, balata, polychloroprene, polynorbornene, polyoctenamer, polypentenamer, butyl rubber, EPR, EPDM, styrene-butadiene, and similar thermoset materials. The crosslinking agent typically includes a metal salt, such as a zinc-, aluminum-, sodium-, lithium-, nickel-, calcium-, or magnesium-salt, of an unsaturated fatty acid or monocarboxylic acid, such as (meth)acrylic acid. Preferred crosslinking agents include zinc acrylate, zinc diacrylate, zinc methacrylate, and zinc dimethacrylate, and mixtures thereof. The crosslinking agent must be present in an amount sufficient to crosslink a portion of the chains of the polymers in the resilient polymer component. The crosslinking agent is generally present in the rubber composition in an amount of from 15 to 30 phr, or from 19 to 25 phr, or from 20 to 24 phr. The desired compression may be obtained by adjusting the amount of crosslinking, which can be achieved, for example, by altering the type and amount of crosslinking agent. The initiator agent can be any known polymerization initiator which decomposes during the cure cycle, including, but not limited to, dicumyl peroxide, 1,1-di-(t-butylperoxy) 3,3,5-trimethyl cyclohexane, a-a bis-(t-butylperoxy)diisopropylbenzene, 2,5-di-(t-butylperoxy)-2,5-dimethyl hexane, di-t-butyl peroxide, n-butyl-4,4-bis(t-butylperoxy)valerate, lauryl peroxide, benzoyl peroxide, t-butyl hydroperoxide, and mixtures thereof.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may also contain one or more fillers to adjust the density and/or specific gravity of the core or cover. Fillers are typically polymeric or mineral particles. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers and combinations thereof. The amount of particulate material(s) present in the rubber composition is typically within a range having a lower limit of 5 parts or 10 parts by weight per 100 parts of the base rubber, and an upper limit of 30 parts or 50 parts or 100 parts by weight per 100 parts of the base rubber. Filler materials may be dual-functional fillers, such as zinc oxide (which may be used as a filler/acid scavenger) and titanium dioxide (which may be used as a filler/brightener material). Further examples of suitable fillers and additives include, but are not limited to, those disclosed in U.S. Pat. No. 7,041,721, the entire disclosure of which is hereby incorporated herein by reference.

The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like. The amount of additive(s) typically present in the rubber composition is typically within a range having a lower limit of 0 parts by weight per 100 parts of the base rubber, and an upper limit of 20 parts or 50 parts or 100 parts or 150 parts by weight per 100 parts of the base rubber.

The rubber composition optionally includes a soft-and-fast agent. As used herein, "soft-and-fast agent" means any compound or a blend thereof that is capable of making a core 1) softer (have a lower compression) at a constant coefficient of restitution ("COR") and/or 2) faster (have a higher COR at equal compression), when compared to a core equivalently prepared without a soft-and-fast agent. Preferably, the rubber composition contains from 0.05 phr to 10.0 phr of a soft-and-fast agent. In one embodiment, the soft-and-fast agent is present in an amount of from 0.05 phr to 3.0 phr, or from 0.05 phr to 2.0 phr, or from 0.05 phr to 1.0 phr. In another embodiment, the soft-and-fast agent is present in an amount of from 2.0 phr to 5.0 phr, or from 2.35 phr to 4.0 phr, or from 2.35 phr to 3.0 phr. In an alternative high concentration embodiment, the soft-and-fast agent is present in an amount of from 5.0 phr to 10.0 phr, or from 6.0 phr to 9.0 phr, or from 7.0 phr to 8.0 phr. In another embodiment, the soft-and-fast agent is present in an amount of 2.6 phr.

Suitable soft-and-fast agents include, but are not limited to, organosulfur or metal-containing organosulfur compounds, an organic sulfur compound, including mono, di, and polysulfides, a thiol, or mercapto compound, an inorganic sulfide compound, a Group VIA compound, a substituted or unsubstituted aromatic organic compound that does not contain sulfur or metal, an aromatic organometallic compound, or mixtures thereof. The soft-and-fast agent component may also be a blend of an organosulfur compound and an inorganic sulfide compound.

Suitable soft-and-fast agents of the present invention include, but are not limited to those having the following general formula:

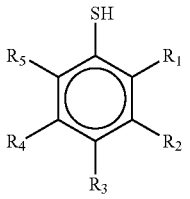

where $R_{1-5}$ can be $C_{1-8}$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; zinc salts thereof; non-metal salts thereof, for example, ammonium salt of pentachlorothiophenol; magnesium pentachlorothiophenol; cobalt pentachlorothiophenol; and mixtures thereof. Preferably, the halogenated thiophenol compound is pentachlorothiophenol, which is commercially-available in neat form or under the tradename STRUKTOL®, a clay-based carrier containing the sulfur compound pentachlorothiophenol loaded at 45 percent (correlating to 2.4 parts PCTP). STRUKTOL® is commercially-available from Struktol Company of America of Stow, Ohio. PCTP is commercially-available in neat and salt forms from eChinachem of San Francisco, Calif. Most preferably, the halogenated thiophenol compound is the zinc salt of pentachlorothiophenol, which is also commercially-available from eChinachem. Additional examples are disclosed in U.S. Pat. No. 7,148,279, the entire disclosure of which is hereby incorporated herein by reference.

As used herein, "organosulfur compound(s)" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Additional suitable examples of soft-and-fast agents include, but are not limited to, 4,4'-diphenyl disulfide; 4,4'-ditolyl disulfide; 2,2'-benzamido diphenyl disulfide; bis(2-aminophenyl)disulfide; bis(4-aminophenyl)disulfide; bis(3-aminophenyl)disulfide; 2,2'-bis(4-aminonaphthyl)disulfide; 2,2'-bis(3-aminonaphthyl)disulfide; 2,2'-bis(4-aminonaphthyl) disulfide; 2,2'-bis(5-aminonaphthyl)disulfide; 2,2'-bis(6-aminonaphthyl)disulfide; 2,2'-bis(7-aminonaphthyl)disulfide; 2,2'-bis(8-aminonaphthyl)disulfide; 1,1'-bis(2-aminonaphthyl) disulfide; 1,1'-bis(3-aminonaphthyl) disulfide; 1,1'-bis(3-aminonaphthyl)disulfide; 1,1'-bis(4-aminonaphthyl)disulfide; 1,1'-bis(5-aminonaphthyl) disulfide; 1,1'-bis(6-aminonaphthyl) disulfide; 1,1'-bis(7-aminonaphthyl)disulfide; 1,1'-bis(8-aminonaphthyl) disulfide; 1,2'-diamino-1,2'-dithiodinaphthalene; 2,3'-diamino-1,2'-dithiodinaphthalene; bis(4-chlorophenyl) disulfide; bis(2-chlorophenyl)disulfide; bis(3-chlorophenyl) disulfide; bis(4-bromophenyl) disulfide; bis(2-bromophenyl) disulfide; bis(3-bromophenyl)disulfide; bis(4-fluorophenyl) disulfide; bis(4-iodophenyl)disulfide; bis(2,5-dichlorophenyl)disulfide; bis(3,5-dichlorophenyl) disulfide; bis(2,4-dichlorophenyl)disulfide; bis(2,6-dichlorophenyl)disulfide; bis(2,5-dibromophenyl)disulfide; bis(3,5-dibromophenyl) disulfide; bis(2-chloro-5-bromophenyl) disulfide; bis(2,4,6-trichlorophenyl)disulfide; bis(2,3,4,5,6-pentachlorophenyl) disulfide; bis(4-cyanophenyl)disulfide; bis(2-cyanophenyl) disulfide; bis(4-nitrophenyl)disulfide; bis(2-nitrophenyl) disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl)disulfide; bis(2-acetylphenyl)disulfide; bis(4-formylphenyl)disulfide; bis(4-carbamoylphenyl)disulfide; 1,1'-dinaphthyl disulfide; 2,2'-dinaphthyl disulfide; 1,2'-dinaphthyl disulfide; 2,2'-bis(1-chlorodinaphthyl)disulfide; 2,2'-bis(1-bromonaphthyl) disulfide; 1,1'-bis(2-chloronaphthyl) disulfide; 2,2'-bis(1-cyanonaphthyl)disulfide; 2,2'-bis(1-acetylnaphthyl)disulfide; and the like; or a mixture thereof. Preferred organosulfur components include 4,4'-diphenyl disulfide, 4,4'-ditolyl disulfide, or 2,2'-benzamido diphenyl disulfide, or a mixture thereof. A preferred organosulfur component includes 4,4'-ditolyl disulfide.

In another embodiment, metal-containing organosulfur components can be used according to the invention. Suitable metal-containing organosulfur components include, but are not limited to, cadmium, copper, lead, and tellurium analogs of diethyldithiocarbamate, diamyldithiocarbamate, and dimethyldithiocarbamate, or mixtures thereof. Additional examples are disclosed in U.S. Pat. No. 7,005,479, the entire disclosure of which is hereby incorporated herein by reference.

Suitable substituted or unsubstituted aromatic organic components that do not include sulfur or a metal include, but are not limited to, 4,4'-diphenyl acetylene, azobenzene, or a mixture thereof. The aromatic organic group preferably ranges in size from $C_{6-20}$, and more preferably from $C_{6-10}$. Suitable inorganic sulfide components include, but are not limited to titanium sulfide, manganese sulfide, and sulfide analogs of iron, calcium, cobalt, molybdenum, tungsten, copper, selenium, yttrium, zinc, tin, and bismuth.

A substituted or unsubstituted aromatic organic compound is also suitable as a soft-and-fast agent. Suitable substituted or unsubstituted aromatic organic components include, but are not limited to, components having the formula $(R_1)_x$—$R_3$-M-$R_4$—$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_{6-24}$ aromatic group; x and y are each an integer from 0 to 5; $R_3$ and $R_4$ are each selected from a single, multiple, or fused ring $C_{6-24}$ aromatic group; and M includes an azo group or a metal component. $R_3$ and $R_4$ are each preferably selected from a $C_{6-10}$ aromatic group, more preferably selected from phenyl, benzyl, naphthyl, benzamido, and benzothiazyl. $R_1$ and $R_2$ are each preferably selected from a substituted or unsubstituted $C_{1-10}$ linear, branched, or cyclic alkyl, alkoxy, or alkylthio group or a $C_{6-10}$ aromatic group. When $R_1$, $R_2$, $R_3$, or $R_4$, are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl or sulfonamide; and phosphates and phosphites. When M is a metal component, it may be any suitable elemental metal available to those of ordinary skill in the art. Typically, the metal will be a transition metal, although preferably it is tellurium or selenium. In one embodiment, the aromatic organic compound is substantially free of metal, while in another embodiment the aromatic organic compound is completely free of metal.

The soft-and-fast agent can also include a Group VIA component. Elemental sulfur and polymeric sulfur are commercially-available from Elastochem, Inc. of Chardon, Ohio. Exemplary sulfur catalyst compounds include PB(RM-S)-80 elemental sulfur and PB(CRST)-65 polymeric sulfur, each of which is available from Elastochem, Inc. An exemplary tellurium catalyst under the tradename TELLOY® and an exemplary selenium catalyst under the tradename VANDEX® are each commercially-available from RT Vanderbilt.

Other suitable soft-and-fast agents include, but are not limited to, hydroquinones, benzoquinones, quinhydrones, catechols, and resorcinols. Suitable hydroquinones are further disclosed, for example, in U.S. Patent Application Publication No. 2007/0213440. Suitable benzoquinones are further disclosed, for example, in U.S. Patent Application Publication No. 2007/0213442. Suitable quinhydrones are further disclosed, for example, in U.S. Pat. No. 7,452,942. Suitable catechols and resorcinols are further disclosed, for example, in U.S. Pat. No. 7,544,730. The entire disclosure of each of these references is hereby incorporated herein by reference.

In a particular embodiment, the soft-and-fast agent is a catechol selected from one or more compounds represented by the following formula, and hydrates thereof:

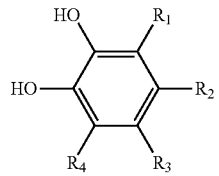

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$).

In another particular embodiment, the soft-and-fast agent is a resorcinol selected from one or more compounds represented by the following formula, and hydrates thereof:

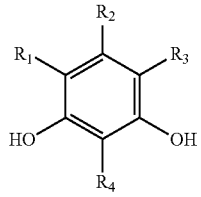

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl);

benzyl (—$CH_2$phenyl)], a nitroso group (—NO), an acetamido group (—$NHCOCH_3$), and a vinyl group (—CH=$CH_2$).

The soft-and-fast agent may be a combination of one or more catechols, each of which is independently selected from compounds represented by the above formula; a combination of one or more resorcinols, each of which is independently selected from compounds represented by the above formula; a combination of at least one catechol and one or more non-catechol soft-and-fast agents including, but not limited to, hydroquinones, benzoquinones, quinhydrones, and resorcinols; or a combination of at least one resorcinol and one or more non-resorcinol soft-and-fast agents including, but not limited to, hydroquinones, benzoquinones, quinhydrones, and catechols.

The catechol or resorcinol is typically used in the form of a liquid or solid. In a particular embodiment, the catechol or resorcinol is used in a solid form and may be synthesized or processed so as to have a particle size of 0.25 mm or less, or 0.125 mm or less, or 0.09 mm or less. In another particular embodiment, the catechol or resorcinol is used in a solid form and melts at 150° F. or less, or 120° F. or less, or at a temperature that is the same as or less than the mixing temperature of the base rubber.

When the soft-and-fast agent includes catechol(s) and/or resorcinol(s), the total amount of catechol(s) and/or resorcinol(s) present in the rubber composition is typically at least 0.1 parts by weight or at least 0.15 parts by weight or at least 0.2 parts by weight per 100 parts of the base rubber, or an amount within the range having a lower limit of 0.1 parts or 0.15 parts or 0.25 parts or 0.3 parts or 0.375 parts by weight per 100 parts of the base rubber, and an upper limit of 0.5 parts or 1 part or 1.5 parts or 2 parts or 3 parts by weight per 100 parts of the base rubber.

In a particular embodiment, the soft-and-fast agent comprises a catechol, and a ratio of the amount of the catechol present in the rubber composition ($P_{CATECHOL}$) measured in parts by weight per 100 parts of the base rubber, to the amount of initiator agent present in the rubber composition ($P_{INITIATOR}$), measured in parts by weight per 100 parts of the base rubber, is from 0.05 to 2. In another embodiment, $P_{CATECHOL}/P_{INITIATOR}$ is at least 0.05 and less than 0.5. In another embodiment, $P_{CATECHOL}/P_{INITIATOR}$ is at least 0.2 and less than 0.5. In another embodiment, $P_{CATECHOL}/P_{INITIATOR}$ is at least 0.25 and less than 0.5. In yet another embodiment, $P_{CATECHOL}/P_{INITIATOR}$ is within the range having a lower limit of 0.05 or 0.2 or 0.25 and an upper limit of 0.4 or 0.45 or 0.5 or 2.

In another particular embodiment, the soft-and-fast agent comprises a resorcinol, and a ratio of the amount of the resorcinol present in the rubber composition ($P_{RESORCINOL}$) measured in parts by weight per 100 parts of the base rubber, to the amount of initiator agent present in the rubber composition ($P_{INITIATOR}$), measured in parts by weight per 100 parts of the base rubber, is from 0.05 to 2. In another embodiment, $P_{RESORCINOL}/P_{INITIATOR}$ is at least 0.05 and less than 0.5. In another embodiment, $P_{RESORCINOL}/P_{INITIATOR}$ is at least 0.2 and less than 0.5. In another embodiment, $P_{RESORCINOL}/P_{INITIATOR}$ is at least 0.25 and less than 0.5. In yet another embodiment, $P_{RESORCINOL}/P_{INITIATOR}$ is within the range having a lower limit of 0.05 or 0.2 or 0.25 and an upper limit of 0.4 or 0.45 or 0.5 or 2.

Examples of commercially-available polybutadienes suitable for use in forming the center include, but are not limited to, BUNA® CB23, commercially-available from Lanxess Corporation; SE BR-1220, commercially-available from The Dow Chemical Company; EUROPRENE NEOCIS® BR 40 and BR 60, commercially-available from Polimeri Europa; UBEPOL-BR® rubbers, commercially-available from UBE Industries, Ltd.; and BR 01 commercially-available from Japan Synthetic Rubber Co., Ltd.

Suitable types and amounts of base rubber, crosslinking agent, filler, co-crosslinking agent, initiator agent and additives are more fully described in, for example, U.S. Pat. Nos. 7,138,460; 6,939,907; 7,041,721; 6,566,483, 6,695,718, and 6,939,907, the entire disclosures of which are hereby incorporated herein by reference.

The center can also be formed from a low deformation material selected from metal, rigid plastics, polymers reinforced with high strength organic or inorganic fillers or fibers, and blends and composites thereof. Suitable low deformation materials also include those disclosed in U.S. Pat. No. 7,004,856, the entire disclosure of which is hereby incorporated herein by reference.

The center may also comprise thermosetting or thermoplastic materials such as polyurethane, polyurea, partially or fully neutralized ionomers, thermosetting polydiene rubber such as polybutadiene, polyisoprene, ethylene propylene diene monomer rubber, ethylene propylene rubber, natural rubber, balata, butyl rubber, halobutyl rubber, styrene butadiene rubber or any styrenic block copolymer such as styrene ethylene butadiene styrene rubber, etc., metallocene or other single site catalyzed polyolefin, polyurethane copolymers, e.g., with silicone, as long as the material meets the desired COR.

The outer core layer is generally formed from a rubber composition. Suitable rubber compositions include those disclosed above.

Additional materials suitable for forming the center and outer core layer include the core compositions disclosed in U.S. Pat. No. 7,300,364, the entire disclosure of which is hereby incorporated herein by reference. For example, suitable core materials include HNPs neutralized with organic fatty acids and salts thereof, metal cations, or a combination of both. In addition to HNPs neutralized with organic fatty acids and salts thereof, core compositions may comprise at least one rubber material having a resilience index of at least about 40. Preferably the resilience index is at least about 50. Polymers that produce resilient golf balls and, therefore, are suitable for the present invention, include but are not limited to CB23 and CB22; BR60, commercially-available from Enichem of Italy, and 1207G, commercially-available from Goodyear Corp. of Akron, Ohio. Additionally, the unvulcanized rubber, such as polybutadiene, in golf balls prepared according to the invention typically has a Mooney viscosity of between about 40 and about 80, more preferably, between about 45 and about 65, and most preferably, between about 45 and about 55. Mooney viscosity is typically measured according to ASTM-D1646.

Referring to FIG. 1, in one embodiment of the present invention the golf ball 10 includes an inner core layer 12, an outer core layer 16, an inner cover layer 14, and an outer cover layer 18. The two-layer core is enclosed with a cover comprising an inner cover layer and an outer cover layer. According to the present invention, the surface hardness of the outer core layer is greater than the material hardness of the inner cover layer. In a particular embodiment, the surface hardness of the outer core layer is greater than both the inner cover layer and the outer cover layer.

There are a number of preferred embodiments of the invention. In one preferred embodiment, the golf ball is formed from a single, solid core, an inner cover layer, and an outer cover layer. The solid core is preferably unitary and homogeneous (i.e., formed from a single composition, such as a polybutadiene composition) and can have any diameter, but preferably the outer diameter is about 1.5 inches to about 1.62 inches, more preferably about 1.51 inches to about 1.60 inches, and most preferably about 1.53 to about 1.58 inches. The solid core has a surface hardness and a geometric center hardness.

The geometric center hardness is preferably about 64 Shore C to about 85 Shore C and the core surface hardness is preferably greater than 85 Shore C. The core surface hardness is more preferably about 86 Shore C to about 98 Shore C and most preferably about 88 Shore C to about 94 Shore C. The core surface hardness is higher (harder) than the geometric center hardness by about 5 Shore C to about 22 Shore C to define a medium positive hardness gradient. Preferably the hardness gradient is about 7 Shore C to about 20 Shore C, more preferably about 10 Shore C to about 18 Shore C. In a particularly preferred embodiment, the geometric center hardness is about 75 Shore C and the core surface hardness is about 89 Shore C to define a medium positive hardness gradient of about 14 Shore C.

In this embodiment, the outer cover layer is formed from a polyurea, a polyurethane, or a hybrid thereof, and has a first hardness, and the inner cover layer has a second hardness greater than the first (cover) hardness and is within about 5 Shore C of the core surface hardness.

In an alternative preferred embodiment, the golf ball is formed from a solid dual core (formed from an inner core layer and an outer core layer), an inner cover layer, and an outer cover layer. The inner core layer has a geometric center hardness of about 66 Shore C to about 80 Shore C and a surface hardness of about 65 Shore C to about 80 Shore C and is about 0 to 5 Shore C, preferably about 1 Shore C to about 5 Shore C, harder than the center hardness to define a shallow positive hardness gradient. The outer core layer preferably has a surface hardness of about 86 Shore C to about 96 Shore C and is harder than the geometric center by about 10 Shore C to about 20 Shore C to define a positive hardness gradient. Preferably, the hardness gradient is about 12 Shore C to about 18 Shore C, more preferably about 13 Shore C to about 16 Shore C. Preferably, the geometric center hardness is about 67 Shore C to about 75 Shore C, more preferably about 68 Shore C to about 72 Shore C.

The outer core layer surface hardness is preferably about 89 Shore C to about 91 Shore C. In one particularly preferred embodiment, the inner core layer preferably has an outer diameter of about 1.0 inches and the outer core layer has an outer diameter of about 1.55 inches. The inner or outer core layers may also be formed from a polybutadiene rubber and about 1 to 100 phr of a stiffening thermoplastic polymer, such as polyisoprene, trans butadiene rubbers, ionomer, acid co- or ter-polymers, polyamides, polyesters, polyoctenemers, styrene butadiene copolymers, polyether-esters, polyamide-esters, or polyethylene copolymers.

The outer cover layer has a Vicker's hardness of about 0.18 to about 0.40, more preferably about 0.2 to about 0.35 as measured on the ball at 0.49 N with a 10-s hold time. The inner cover layer is formed from an ionomer or ionomer-based blend and is typically disposed between the core and the outer cover layer. The inner or outer cover layers may be formed from an ionomer or a blend thereof, a polyurea, a polyurethane, a urethane-urea hybrid, a urea-urethane hybrid, a castable epoxy, a metallocene-catalyzed polyolefin, ionomers, ethylene-acrylic or -methacrylic acid copolymers or terpolymers, highly-neutralized ionomers, thermoset diene rubbers, polyether-esters, polyether-amides, or polyamide-esters.

In another preferred embodiment, the golf ball is formed from an inner core layer, an outer core layer, an inner cover layer, and an outer cover layer. The inner core layer has a geometric center hardness of about 66 Shore C to about 82 Shore C and a surface hardness of about 62 Shore C to about 78 Shore C. The surface hardness is lower (softer) than the center hardness to define a "negative hardness gradient." Preferably, the geometric center hardness is about 70 Shore C to about 80 Shore C and/or the core surface hardness is about 66 Shore C to about 74 Shore C. The outer core layer preferably has a surface hardness of about 86 Shore C to about 96 Shore C, and is harder than the geometric center by about 10 Shore C to about 20 Shore C to define a "positive hardness gradient." The positive hardness gradient is more preferably about 12 Shore C to 18 Shore C, and most preferably about 13 Shore C to about 16 Shore C. The outer core layer may also include a stiffening thermoplastic polymer, The outer cover layer is preferably formed from a polyurea, a polyurethane, or a hybrid thereof. The outer cover layer should have a Vicker's hardness of about 0.18 to about 0.40, as measured on the ball at 0.49 N with a 10-s hold time. The inner cover layer is preferably formed from an ionomer or ionomer blend, and is generally disposed between the core and the outer cover layer.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. The hardness values given herein for cover materials, including inner cover layer materials and outer cover layer materials, are material hardness values, with all values reported following 10 days of aging at 50% relative humidity and 23° C.

In an effort to alleviate influence of sub-layers/materials on hardness measurements of thin layers, such as those in a golf ball cover, a microindentation hardness method is also used herein. The Vickers hardness measurements are made according to ASTM E384-09 "Standard Test Method for Microindentation Hardness of Materials." ASTM E384-09 microindentation tests extend hardness testing to materials too thin or too small for macroindentation tests, such as the Shore-type tests described by ASTM D2240. The pyramid-shaped Vickers indenter leaves a micro-sized indentation containing two 'marks' (perpendicular to each other, much like an 'x-y' axis, resulting from the edges of the 'pyramid') on the surface being tested and a microscope is used to find and measure the diagonals ($d_1$ and $d_2$) of the indentation. The length of the diagonals (d) and the force applied (F, in N or gF) are used to calculate a hardness value for the material, HV ($HV=0.102\ F/A=0.1891\ F/d^2$, where F is the test load and A is the indentation surface area). Because most of the recovery of the material is in the depth of penetration and not in the diagonals, the Vickers hardness is much less affected by material recovery or lack thereof between measurements (as all too evident in Shore-type measurements).

The surface to be measured must be smooth enough that indentations as little as 10 μm (less than half a mil) can be accurately measured. It is also important that the sample be centered and that the surface be parallel to the stage in order to produce a consistent indentation to achieve a reasonably regular tetrahedron.

The inner cover layer preferably has a material hardness of 95 Shore C or less, or less than 95 Shore C, or 92 Shore C or less, or 90 Shore C or less, or has a material hardness within a range having a lower limit of 70 or 75 or 80 or 84 or 85 Shore C and an upper limit of 90 or 92 or 95 Shore C. The thickness of the inner cover layer is preferably within a range having a lower limit of 0.010 or 0.015 or 0.020 or 0.030 inches and an upper limit of 0.035 or 0.045 or 0.080 or 0.120 inches.

The outer cover layer preferably has a material hardness of 85 Shore C or less. The thickness of the outer cover layer is preferably within a range having a lower limit of 0.010 or 0.015 or 0.025 inches and an upper limit of 0.035 or 0.040 or 0.055 or 0.080 inches.

Suitable materials for forming the inner and outer cover layer include ionomer resins and blends thereof (particularly SURLYN® ionomer resins), polyurethanes, polyureas, (meth)acrylic acid, thermoplastic rubber polymers, polyethylene, and synthetic or natural vulcanized rubber, such as balata. Suitable commercially-available ionomeric cover materials include, but are not limited to, SURLYN® ionomer resins and HPF 1000 and HPF 2000.

Also suitable for forming cover layers are blends of ionomers with thermoplastic elastomers. Suitable ionomeric cover materials are further disclosed, for example, in U.S. Pat. Nos. 6,653,382; 6,756,436; 6,894,098; 6,919,393; and 6,953,820, the entire disclosures of which are hereby incorporated by reference. Suitable polyurethane cover materials are further disclosed in U.S. Pat. Nos. 5,334,673; 6,506,851; and 6,756,436, the entire disclosures of which are hereby incorporated herein by reference. Suitable polyurea cover materials are further disclosed in U.S. Pat. Nos. 5,484,870 and 6,835,794, the entire disclosures of which are hereby incorporated herein by reference. Suitable polyurethane-urea hybrids are blends or copolymers comprising urethane or urea segments as disclosed in U.S. Patent Application Publication No. 2007/0117923, the entire disclosure of which is hereby incorporated herein by reference. Additional suitable cover materials are disclosed, for example, in U.S. Pat. No. 7,182,702 and 5,919,100; and PCT Publications WO 00/23519 and 00/29129, the entire disclosures of which are hereby incorporated herein by reference.

The inner cover layer is preferably formed from a composition comprising an ionomer or a blend of two or more ionomers. In a particular embodiment, the inner cover layer is formed from a composition comprising a high acid ionomer. For purposes of the present disclosure, "high acid ionomer" includes ionomers having an acid content of greater than 16 wt %. A particularly suitable high acid ionomer is SURLYN® 8150, which is a copolymer of ethylene and methacrylic acid, having an acid content of 19 wt %, which is 45% neutralized with sodium. In another particular embodiment, the inner cover layer is formed from a composition comprising a high acid ionomer and a maleic anhydride-grafted non-ionomeric polymer. A particularly suitable maleic anhydride-grafted polymer is FUSABOND® 572D, commercially-available from DuPont. FUSABOND® 572D is a maleic anhydride-grafted, metallocene-catalyzed ethylene-butene copolymer having about 0.9 wt % maleic anhydride grafted onto the copolymer. A particularly preferred blend of high acid ionomer and maleic anhydride-grafted polymer is a 84 wt %/16 wt % blend of SURLYN® 8150 and FUSABOND® 572D. Blends of high acid ionomers with maleic anhydride-grafted polymers are further disclosed, for example, in U.S. Pat. Nos. 6,992,135 and 6,677,401, the entire disclosures of which are hereby incorporated herein by reference.

In another particular embodiment, the inner cover layer is preferably formed from a composition comprising a 50/45/5 blend of SURLYN® 8940/SURLYN® 9650/NUCREL® 960, and, in a particularly preferred embodiment, has a material hardness of from 80 to 85 Shore C. In another particular embodiment, the inner cover layer is preferably formed from a composition comprising a 50/25/25 blend of SURLYN® 8940/SURLYN® 9650/SURLYN® 9910, preferably having a material hardness of about 90 Shore C. In yet another particular embodiment, the inner cover layer is preferably formed from a composition comprising a 50/50 blend of SURLYN® 8940/SURLYN® 9650, preferably having a material hardness of about 86 Shore C. SURLYN® 8940 is an E/MAA copolymer in which the MAA acid groups have been partially neutralized with sodium ions. SURLYN® 9650 and SURLYN® 9910 are two different grades of E/MAA copolymer in which the MAA acid groups have been partially neutralized with zinc ions. NUCREL® 960 is an E/MAA copolymer resin nominally made with 15 wt % methacrylic acid. NUCREL® resins are commercially-available from DuPont. Non-limiting examples of preferred inner cover layer materials are shown in the Examples below.

Ionomeric compositions of the present invention can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, PEBAX® thermoplastic polyether block amides commercially-available from Arkema Inc., styrene-butadiene-styrene block copolymers, styrene(ethylene-butylene)-styrene block copolymers, polyamides, polyesters, polyolefins (e.g., polyethylene, polypropylene, ethylene-propylene copolymers, ethylene-(meth)acrylate, ethylene-(meth)acrylic acid, functionalized polymers with maleic anhydride grafting, functionalized polymers with epoxidation, elastomers (e.g., EPDM, metallocene-catalyzed polyethylene) and ground powders of the thermoset elastomers. The inner cover layer material may include a flow modifier, such as, but not limited to, NUCREL® acid copolymer resins, and particularly NUCREL® 960.

The outer cover layer is preferably formed from a composition comprising polyurethane, polyurea, or a copolymer or hybrid of polyurethane/polyurea. The outer cover layer material may be thermoplastic or thermoset.

In a particularly preferred embodiment, the present invention provides a golf ball consisting of: a center, an outer core layer, an inner cover layer, and an outer cover layer. The center is preferably formed from a rubber composition and, in a particularly preferred embodiment, has one or more of the following properties: a diameter of about 1.25 inches, a compression of about 35, a center hardness of about 60 Shore C, and a surface hardness of about 75 Shore C. The rubber composition of the center preferably has the following formulation: 100 parts high-cis butadiene rubber, 22 phr zinc diacrylate, 5 phr zinc oxide, $BaSO_4$ in amount necessary to achieve the desired specific gravity, 0.5 phr zinc pentachlorothiophenol, 1.2 phr Perkadox BC, and from 10 to 20 phr regrind material. The outer core is preferably formed from a rubber composition preferably having the following formulation: 93 parts high-cis butadiene rubber, 7 parts polyisoprene, 45-50 phr zinc diacrylate, zinc oxide in amount necessary to achieve the desired specific gravity, 0.5 phr zinc pentachlorothiophenol, 1,2phr PERKADOX®BC, 0.4 phr MBPC antioxidant, and 10-20 phr regrind material. The overall two-layer core preferably has one or more of the following properties: an overall diameter of about 1.53 inches, a dual core compression of about 80, an outer core layer surface hardness of about 92 Shore C, and a core hardness gradient of about 32 Shore C. The inner cover layer is preferably formed from a composition comprising a 84 wt %/16 wt % blend of SURLYN® 8150 and FUSABOND® 572D. The inner cover layer preferably has a material hardness of from 85 to 92 Shore C. The outer cover layer is preferably formed from a polyurethane or polyurea composition.

A moisture vapor barrier layer is optionally employed between the core and the cover. Moisture vapor barrier layers are further disclosed, for example, in U.S. Pat. Nos. 6,632,147; 6,932,720; 7,004,854; and 7,182,702, the entire disclosures of which are hereby incorporated herein by reference.

In addition to the materials disclosed above, any of the core or cover layers may comprise one or more of the following materials: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, styrene-acrylonitrile, olefin-modified styrene-acrylonitrile, acrylonitrile-styrene-acrylonitrile, styrene-maleic anhydride polymer, styrenic copolymer, functionalized styrenic copolymer, functionalized styrenic terpolymer, styrenic terpolymer, cellulose polymer, liquid crystal polymer, ethylene-propylene-diene rubber, ethylene-vinyl acetate copolymer, ethylene propylene rubber, ethylene vinyl acetate, polyurea, and polysiloxane. Suitable polyamides for use as an additional material in compositions disclosed herein also include resins obtained by: (1) polycondensation of (a) a dicarboxylic acid, such as oxalic acid, adipic acid, sebacic acid, terephthalic acid, isophthalic acid or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine or m-xylylenediamine; (2) a ring-opening polymerization of cyclic lactam, such as 8-caprolactam or w-laurolactam; (3) polycondensation of an aminocarboxylic acid, such as 6-aminocaproic acid, 9-aminononanoic acid, 11-aminoundecanoic acid or 12-aminododecanoic acid; or (4) copolymerzation of a cyclic lactam with a dicarboxylic acid and a diamine. Specific examples of suitable polyamides include NYLON® 6, NYLON® 66, NYLON® 610, NYLON® 11, NYLON® 12, copolymerized NYLON®, NYLON® MXD6, and NYLON® 46.

Other preferred materials suitable for use as an additional material in golf ball compositions disclosed herein include SKYPEL® polyester elastomers, commercially-available from SK Chemicals of South Korea; SEPTON® diblock and triblock copolymers, commercially-available from Kuraray Corporation of Kurashiki, Japan; and KRATON® diblock and triblock copolymers, commercially-available from Kraton Polymers LLC of Houston, Tex.

Ionomers are also well suited for blending with compositions disclosed herein. Suitable ionomeric polymers include α-olefin/unsaturated carboxylic acid copolymer- or terpolymer-type ionomeric resins. Copolymeric ionomers are obtained by neutralizing at least a portion of the carboxylic groups in a copolymer of an α-olefin and an α,β-unsaturated carboxylic acid having from 3 to 8 carbon atoms, with a metal ion. Terpolymeric ionomers are obtained by neutralizing at least a portion of the carboxylic groups in a terpolymer of an α-olefin, an α,β-unsaturated carboxylic acid having from 3 to 8 carbon atoms, and an α,β-unsaturated carboxylate having from 2 to 22 carbon atoms, with a metal ion. Examples of suitable α-olefins for copolymeric and terpolymeric ionomers include ethylene, propylene, 1-butene, and 1-hexene. Examples of suitable unsaturated carboxylic acids for copolymeric and terpolymeric ionomers include acrylic, methacrylic, ethacrylic, α-chloroacrylic, crotonic, maleic, fumaric, and itaconic acid. Copolymeric and terpolymeric ionomers include ionomers having varied acid contents and degrees of acid neutralization, neutralized by monovalent or bivalent cations as disclosed herein. Examples of commercially-available ionomers suitable for blending with compositions disclosed herein include SURLYN® and IOTEK® ionomer resins.

Silicone materials are also well suited for blending with compositions disclosed herein. Suitable silicone materials include monomers, oligomers, prepolymers, and polymers, with or without adding reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl, and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl, and xylyl; aralkyl groups, such as benzyl and phenethyl; and halogenated alkyl groups, such as 3,3,3-trifluoropropyl and chloromethyl. Another type of suitable silicone material is one having hydrocarbon groups that lack aliphatic unsaturation. Specific examples include: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxyl-endblocked methylphenylsiloxane-dimethylsiloxane-methylvinysiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and the copolymers listed above wherein at least one group is dimethylhydroxysiloxy. Examples of commercially-available silicones suitable for blending with compositions disclosed herein include SILASTIC® silicone rubber, commercially-available from Dow Corning Corporation of Midland, Mich.; BLENSIL® silicone rubber, commercially-available from General Electric Company of Waterford, N.Y.; and ELASTOSIL® silicones, commercially-available from Wacker Chemie AG of Germany.

Other types of copolymers can also be added to the golf ball compositions disclosed herein. For example, suitable copolymers comprising epoxy monomers include styrene-butadiene-styrene block copolymers in which the polybutadiene block contains an epoxy group, and styrene-isoprene-styrene block copolymers in which the polyisoprene block contains epoxy. Examples of commercially-available epoxy functionalized copolymers include ESBS® A1005, ESBS® A1010, ESBS® A1020, ESBS® AT018, and ESBS® AT019 epoxidized styrene-butadiene-styrene block copolymers, commercially-available from Daicel Chemical Industries, Ltd. of Japan.

Ionomeric compositions used to form golf ball layers of the present invention can be blended with non-ionic thermoplastic resins, particularly to manipulate product properties. Examples of suitable non-ionic thermoplastic resins include, but are not limited to, polyurethane, poly-ether-ester, polyamide-ether, polyether-urea, PEBAX® thermoplastic polyether block amides, styrene-butadiene-styrene block copolymers, styrene(ethylene-butylene)-styrene block copolymers, polyamides, polyesters, polyolefins (e.g., polyethylene, polypropylene, ethylene-propylene copolymers, ethylene-(meth)acrylate, ethylene-(meth)acrylic acid, functionalized polymers with maleic anhydride grafting, epoxidation, etc., elastomers (e.g., EPDM, metallocene-catalyzed polyethylene) and ground powders of the thermoset elastomers.

Also suitable for forming the core are the compositions having high COR when formed into solid spheres disclosed in U.S. Pat. Nos. 6,953,820 and 6,653,382, the entire disclosures of which are hereby incorporated herein by reference.

The present invention is not limited by any particular process for forming the golf ball layer(s). It should be understood that the layer(s) can be formed by any suitable technique, including injection molding, compression molding, casting, and reaction injection molding.

Golf balls of the present invention typically have a coefficient of restitution of 0.70 or greater, preferably 0.75 or greater, and more preferably 0.78 or greater. Golf balls of the present invention typically have a compression of 40 or greater, or a compression within a range having a lower limit of 50 or 60 and an upper limit of 100 or 120. Cured polybutadiene-based compositions suitable for use in golf balls of the present invention typically have a hardness of 15 Shore A or greater, and preferably have a hardness of from 30 Shore A to 80 Shore D, more preferably from 50 Shore A to 60 Shore D.

Golf balls of the present invention will typically have dimple coverage of 60% or greater, preferably 65% or greater, and more preferably 75% or greater.

The United States Golf Association specifications limit the minimum size of a competition golf ball to 1.680 inches. There is no specification as to the maximum diameter, and golf balls of any size can be used for recreational play. Golf balls of the present invention can have an overall diameter of any size. The preferred diameter of the present golf balls is from 1.680 inches to 1.800 inches. More preferably, the present golf balls have an overall diameter of from 1.680 inches to 1.760 inches, and even more preferably from 1.680 inches to 1.740 inches.

Golf balls of the present invention preferably have a moment of inertia ("MOI") of 70-95 $g \cdot cm^2$, preferably 75-93 $g \cdot cm^2$, and more preferably 76-90 $g \cdot cm^2$. For low MOI embodiments, the golf ball preferably has an MOI of 85 $g \cdot cm^2$ or less, or 83 $g \cdot cm^2$ or less. For high MOI embodiment, the golf ball preferably has an MOI of 86 $g \cdot cm^2$ or greater, or 87 $g \cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

Golf ball cores of the present invention preferably have an overall dual-core compression of from 75 to 90, or from 60 to 85, or a compression of about 80. Golf ball centers of the present invention preferably have a compression of 40 or less, or from 20 to 40, or a compression of about 35.

Compression is an important factor in golf ball design. For example, the compression of the core can affect the ball's spin rate off the driver and the feel. Several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading.

Golf ball cores of the present invention preferably have a zero or "positive hardness gradient." The hardness gradient is defined by hardness measurements made at the surface of the inner core (or outer core layer) and radially inward towards the center of the inner core, typically at 2-mm increments. For purposes of the present invention, the term "positive" with respect to the hardness gradient refers to the result of subtracting the hardness value at the innermost portion of the golf ball component from the hardness value at the outer surface of the component. For example, if the outer surface of a solid core has a higher hardness value than the center (i.e., the surface is harder than the center), the hardness gradient will be deemed a "positive" gradient. Hardness gradients are measured by preparing the core according to the procedure given above for measuring the center hardness of the core. Hardness measurements at any distance from the center of the core are then measured by drawing a line radially outward from the center mark, and measuring and marking the distance from the center, typically in 2-mm increments. All hardness measurements performed on a plane passing through the geometric center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point, e.g., at the center of the core for a single, solid core, such that a core surface softer than its center will have a "negative hardness gradient" and a core surface harder than its center will have a positive hardness gradient. Hardness gradients are disclosed more fully, for example, in U.S. Pat. No. 7,429,221, the entire disclosure of which is hereby incorporated herein by reference.

EXAMPLES

It should be understood that the examples below are for illustrative purposes only. In no manner is the present invention limited to the specific disclosures therein.

Twelve ionomeric inner cover layer compositions according to the present invention were prepared by melt blending SURLYN® 8150 and FUSABOND® 572D in a twin screw extruder, at a temperature of at least 450° F. Flex bars of each blend composition were formed and evaluated for hardness following 10 days of aging at 50% relative humidity and 23° C. The results are reported in TABLE 1.

TABLE 1

| Example | SURLYN ® 8150, wt % | FUSABOND ® 572D, wt % | Shore C Hardness |
|---|---|---|---|
| 1 | 89 | 11 | 91.2 |
| 2 | 84 | 16 | 89.8 |
| 3 | 84 | 16 | 90.4 |
| 4 | 84 | 16 | 89.6 |
| 5 | 81 | 19 | 88.9 |
| 6 | 80 | 20 | 89.1 |
| 7 | 78 | 22 | 88.1 |
| 8 | 76 | 24 | 87.6 |
| 9 | 76 | 24 | 87.2 |
| 10 | 73 | 27 | 86.6 |
| 11 | 71 | 29 | 86.7 |
| 12 | 67 | 33 | 84.0 |

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising:

a single, unitary, homogeneous core having a surface hardness and a geometric center hardness, the core having an outer diameter of about 1.5 to about 1.62 inches;

an outer cover layer comprising a polyurea, a polyurethane, or a hybrid thereof, and having a first hardness; and an inner cover layer disposed between the core and the outer cover layer, the inner cover layer having a second hardness greater than the first hardness and within 5 Shore C of the core surface hardness;

wherein the geometric center hardness is about 64 Shore C to about 85 Shore C, and the core surface hardness is greater than 85 Shore C and harder than the geometric center hardness by 5 to 14 Shore C to define a medium positive hardness gradient.

2. The golf ball of claim 1, wherein the medium positive hardness gradient is 7 to 14 Shore C.

3. The golf ball of claim 2, wherein the medium positive hardness gradient is 10 to 14 Shore C.

4. The golf ball of claim 1, wherein the core surface hardness is about 86 to 98 Shore C.

5. The golf ball of claim 4, wherein the core surface hardness is about 88 to 94 Shore C.

6. The golf ball of claim 1, wherein the core diameter is about 1.53 to 1.58 inches.

7. The golf ball of claim 1, wherein the geometric center hardness is about 75 Shore C and the core surface hardness is about 89 Shore C.

* * * * *